US005324419A

United States Patent [19]

Muldowney

[11] Patent Number: 5,324,419

[45] Date of Patent: Jun. 28, 1994

[54] FCC TO MINIMIZE BUTADIENE YIELDS

[75] Inventor: Gregory P. Muldowney, Glen Mills, Pa.

[73] Assignee: Mobil Oil Corporation, Fairfax, Va.

[21] Appl. No.: 1,703

[22] Filed: Jan. 7, 1993

[51] Int. Cl.[5] ..... C10G 11/18; C10G 11/05

[52] U.S. Cl. ..... 208/120; 208/113; 208/132; 208/118; 208/159

[58] Field of Search ..... 208/480, 157, 85, 67, 208/120, 113, 108, 73, 78, 61, 114, 111, 154

[56] References Cited

U.S. PATENT DOCUMENTS 4,800,014 1/1989 Hays et al. ..... 208/157
4,960,503 10/1990 Haun et al. ..... 208/85
5,073,249 12/1991 Owen ..... 208/480

OTHER PUBLICATIONS

Ind. Eng. Chem. Res., vol. 29, No. 6 Avidan et al. 1990* "Development of Catalytic Cracking Technology".
*The Chemistry and Technology of Petroleum,* Speight, James G., Marcel Dekker, Inc., New York (1990).

*Primary Examiner*—R. Bruce Breneman
*Assistant Examiner*—Bekir L. Yildirim
*Attorney, Agent, or Firm*—Alexander J. McKillop; Malcolm D. Keen; Richard D. Stone

[57] ABSTRACT

A process for fluidized catalytic cracking of heavy feed to make more catalytically cracked products and less thermally cracked products such as butadiene is disclosed. Operating an upflow riser reactor with a riser top temperature of 1050 to 1150 °F., and a short catalyst residence time, yields large volumes of gasoline and light olefins, but reduced yields of butadiene. Preferably cooled catalyst in large amounts contacts severely preheated feed. FCC catalyst with over 30 wt % Y zeolite is preferred.

20 Claims, 3 Drawing Sheets

FCC TO MINIMIZE BUTADIENE YIELDS

FIELD OF THE INVENTION

This invention relates to fluid catalytic cracking.

BACKGROUND OF THE INVENTION

Many modern refineries devote extraordinary amounts of energy and operating expense to convert most of a whole crude oil feed into high octane gasoline. The crude is fractionated into a virgin naphtha fraction which is usually reformed, and gas oil and/or vacuum gas oil fraction which are catalytically cracked in a fluidized catalytic cracking unit (FCC) unit.

A solid cracking catalyst in a finely divided form, with an average particle size of about 60–75 microns, is used. When well mixed with gas, the catalyst acts like a fluid (hence the designation FCC) and may be circulated in a closed flow loop between a cracking zone and a separate regeneration zone.

The Kellogg Ultra Orthoflow converter, Model F, shown in FIG. 1 of this patent application, and also shown as FIG. 17 of the January 8, 1990 Oil & Gas Journal, is an example of a modern, efficient FCC unit. This design (and many other FCC designs) converts a heavy feed into a spectrum of valuable cracked products in a riser reactor in 4–10 seconds of catalyst residence time.

In the cracking zone, hot catalyst contacts the feed to heat the feed, effect the desired cracking reactions and deposit coke on the catalyst. The catalyst is then separated from cracked products which are removed from the cracking reactor for further processing. The coked catalyst is stripped and then regenerated.

A further description of the catalytic cracking process may be found in the monograph, "Fluid Catalytic Cracking with Zeolite Catalysts", Venuto and Habib, Marcel Dekker, N.Y., 1978, incorporated by reference.

The FCC process is an efficient converter of heavy feed to lighter products, and has some favorable peculiarities. The FCC unit rejects the worst components of the feed as coke and regenerates the catalyst by burning this coke to supply the heat needed for the endothermic cracking reaction. On a volume basis it makes more product than feed. This "swell"—the expanded volume of liquid products after cracking a heavy feed—is one reason the process is so profitable.

FCC produces some of the dirtiest and some of the cleanest fuels. The FCC gasoline is a fairly "dirty" fuel. Although of high octane, the FCC naphtha contains significant amounts of benzene and large amounts of olefins. It will contain a significant amount of sulfur, though this can be reduced by hydrotreating the feed. Hydrotreating the FCC naphtha is not so successful, because hydrotreating enough to remove sulfur and olefins also reduces the octane.

FCC light olefins are potentially some of the cleanest fuels in a refinery. Some refiners consider FCC units to be olefin factories. Most FCC operators use the produced olefins in an HF or sulfuric acid alkylation unit or in an olefin oligomerization or polymerization unit. These fuels, especially the alkylates, which are built up from relatively clean starting materials, have little or no benzene or olefins.

One problem with processing FCC olefins is butadiene. These are extremely reactive in themselves, and undesirable, but also lead to formation of acid soluble oils and excessive acid consumption in, e.g., an HF alkylation unit. Light di-olefins are believed to be primarily the result of thermal rather than catalytic cracking of fresh feed, and are usually considered inherent in the FCC process. Usually butadiene production increases as FCC riser top temperature increases.

Refiners have tried to improve yields in catalytic cracking by changing catalyst and changing reaction conditions. Now essentially all refiners use zeolite cracking catalyst. In the 70's, catalyst with perhaps 10 wt % Y zeolite was common, but now many units use makeup catalyst with 30 to 40 wt % Y zeolite.

Partly in response to the availability of more active catalysts, FCC units have also evolved toward ever shorter reaction times. From dense bed cracking in the 40's and 50's, to hybrid units operating with dense bed and riser cracking, to modern units using all riser cracking, the trend to shorter contact times continues. Many units now practice quick separation of cracked products from spent catalyst exiting the riser to further improve yields. These units (short contact time, quick separation of catalyst and cracked product) usually operate at higher temperatures, which increases unwanted thermal reactions. Increased butadiene content is a measure of unwanted thermal reactions, but is by no means the only undesired side effect of higher temperatures.

The patent literature is replete with references to short contact time cracking, but almost all commercial units operate with riser reactors, with 4 to 10 seconds of catalyst residence time, and with riser top temperatures of about 950° to 1025° F.

Work has been done on ultra-short contact time cracking processes, with less success. Part of the motivation for the ultra-short contact time process was the general belief that higher temperatures and shorter contact time would lead to reduced coke make. Because the activation energy for cracking is higher than for coking, it was thought that higher temperatures would give lower coke selectivity.

The two main variants of short contact time cracking reactors (upflow riser and falling solids) will now be reviewed.

SHORT CONTACT TIME RISER CRACKING

In general, it is easy to devise a short contact time riser cracking process, but the yields have always been poor, usually reflecting excessive production of butadiene.

It is easy to design a short contact time riser cracking process because of the way the riser crackers work. The 1250°–1450° F. catalyst heats the FCC feed by direct contact heat exchange, to continue the process. Although there is some delay in vaporizing and heating the usually liquid feed from 600° F. or so, much of the feed can usually be vaporized within 10' in a riser reactor more than 100' high, although some poorly atomized feed and some very high boiling feed components may remain liquid much further up the riser. High temperatures and short contact times merely require large amounts of catalyst and a short riser. This easy route to short residence time cracking has never been used commercially, so far as is known, probably because of excessive thermal cracking from high temperatures. Riser contact times have been reduced from 10 to 15 seconds catalyst residence time for older units to 4–6 seconds for new units, more in response to the availability of higher activity catalysts rather than a willingness to exceed 1015° F. riser top temperature. I am not aware of any riser cracking units operating with catalyst residence times below about 1 or 1½ seconds.

SHORT CONTACT TIME FALLING SOLIDS REACTOR

Several falling solids designs have evolved, among them falling curtain and falling rope reactors. A falling rope design will be reviewed in this section, the Quick Contact (QC) process.

The Quick Contact (QC) process was developed starting in 1973 by Stone & Webster Engineering. The hardware included a special mixing module which injected vapor feed annularly into four high density jets of falling solids, followed by a straight downflow reactor and an inertial separator. Contact times in the reactor were 0.07 to 1.0 seconds at temperatures of 900° to 1800° F. and 0 to 15 psig. Cat:oil ratios exceeded 10. The process was demonstrated in a bench scale unit in 1975, and in a 250 BPD test unit in 1982. So far as is known, the process has not been able to achieve stable operation with heavy oil feeds.

Additional work was done in the laboratory, under my direction and unrelated to the QC process, to develop and test a viable short contact time downflow cracking process. This work involved a converted biomass/hot sand cracking reactor, modified to permit use of FCC catalyst. Multiple tests showed that efficient bottoms conversion could be achieved with high temperatures, but efficient bottoms conversion was always accompanied by overcracking of the gasoline fraction.

In seeking to develop a viable short contact time cracking process I reviewed internal studies, which had investigated cracking at higher temperatures and/or shorter contact times. Much of the work was inconclusive either because contradictory results were obtained in different studies, or because a tradeoff was identified which made it impossible to generalize on the benefits of the new operating conditions. For example, one study showed gasoline selectivity reached an optimum at 3 seconds contact time, but octane was lower by 1 to 3 numbers depending on catalyst. Other work in the 3–7 second contact time range showed that higher reactor temperature reduced both coke and gasoline selectivities, while a follow-up study showed gasoline selectivity increased monotonically at shorter contact time within the range of 3 to 7 seconds.

The state of the art could be summarized as follows. Short residence time cracking is easily achievable in a commercial riser, but the yields are poor and indicate too much thermal cracking. While better yields can theoretically be achieved in a short contact time falling solids reactor, there are many hardware difficulties remaining and reduced thermal cracking may be difficult to achieve.

I believed there was a better way to crack heavy feeds, and that current cracking conditions were not the best, although used for decades in more than 100 FCC units. I did additional work in a laboratory FCC riser and discovered a way to operate a riser catalytic cracking unit so that the benefits of short contact time could be achieved, but with tactics to reduce thermal reactions (as conveniently measured by butadiene production) I found a relatively narrow operating window which gave efficient conversion and reduced thermal reactions, despite higher temperature operation. I did not have to resort to a radical change in reactor design, because my preferred operating conditions could be achieved with little or no modification of a conventional riser cracking unit. I avoided the unusually high temperatures called for by the ultra short contact time cracking reactors. These were not needed, and in fact were harmful. My FCC process worked best with a high degree of feed preheat, and very large amounts of catalyst at a temperature considered too cool for use in FCC units.

BRIEF SUMMARY OF THE INVENTION

Accordingly, the present invention provides a process for the fluidized catalytic cracking of a feed containing hydrocarbons boiling above 650° F. comprising preheating said feed to a temperature above 650° F. and sufficient to vaporize at least 50 wt % of said feed and produce a preheated feed; charging to a base portion of a riser reactor said preheated feed and a stream of cooled, regenerated fluidized catalytic cracking catalyst containing at least 25 wt % large pore zeolite, based on the zeolite content of makeup catalyst to said cracking unit, and wherein the weight ratio of cooled, regenerated catalyst to preheated feed is at least 7.5:1 and produces a catalyst and feed mixture having a mix temperature of at least 1050° F. but below 1200° F.; riser cracking said mixture in said riser reactor for a catalyst residence time of less than 1.5 seconds to produce a mixture of cracked products and spent catalyst which are discharged from an upper portion of said riser reactor at a riser top temperature between 1025° and 1125° F.; separating said discharged mixture to produce a stream of catalytically cracked products which are removed as a product and a stream of spent catalyst containing entrained and absorbed catalytically cracked products and coke; stripping said spent catalyst in a stripping means by contact with a stripping gas at stripping conditions to produce stripped catalyst; regenerating said stripped catalyst in a catalyst regeneration means at catalyst regeneration conditions including a temperature above 1150° F. and contact with an oxygen containing gas to burn coke from spent catalyst, and produce regenerated catalyst having a temperature above 1150° F.; and cooling said regenerated catalyst in a catalyst cooling means to produce cooled regenerated catalyst;recycling said cooled regenerated catalyst to said cracking reactor to contact said feed.

In another embodiment, the method of cracking a heavy feed comprising at least 10 wt % hydrocarbons not recoverable by distillation at atmospheric pressure to catalytically cracked products including at least 50 LV % gasoline and less than 0.15 wt % butadiene, based on weight of fresh feed to said cracking reactor, comprising preheating said feed to a temperature above 700° F.; contacting in the base of a riser reactor said preheated feed with a stream of cooled fluidized catalytic cracking catalyst containing at least 30 wt % Y zeolite, based on the Y zeolite content of makeup catalyst to said cracking unit, to produce a catalyst and feed mixture having a temperature of 1050° F. to 1150° F.; riser cracking said mixture for a catalyst residence time of 0.5 to 1.0 seconds to produce a mixture of cracked products and spent catalyst which are discharged at a reactor outlet temperature, and wherein the reaction conditions include a cat:oil weight ratio above 10: and a riser reactor outlet temperature of 1050° to 1100° F.; separating said mixture to produce a stream of catalytically cracked products which are removed as a product and a stream of spent catalyst containing entrained and absorbed catalytically cracked products and coke; analyzing at least the C4+ portion of said cracked products to determine the gasoline yield and the butadiene content thereof and reducing reaction severity by adjusting at least one of the catalyst residence time and riser outlet temperature in response to said butadiene when butadiene content increases above a predetermined level below 1500 wt ppm of feed, and increasing reaction severity when gasoline yield decreases below a predetermined level equal to at least 50 LV % of fresh feed; stripping said spent catalyst in a stripping means by contact with a stripping gas at stripping conditions to produce stripped catalyst; regenerating said stripped catalyst in a catalyst regeneration means at catalyst regeneration conditions including contact with an oxygen containing gas to produce regenerated catalyst having a temperature above 1300° F.; cooling, in a catalyst cooling means, said regenerated catalyst, to produce cooled regenerated catalyst having a temperature below 1200° F.; and recycling said cooled regenerated catalyst to said cracking reactor to contact said feed.

DETAILED DESCRIPTION

Figure 1:
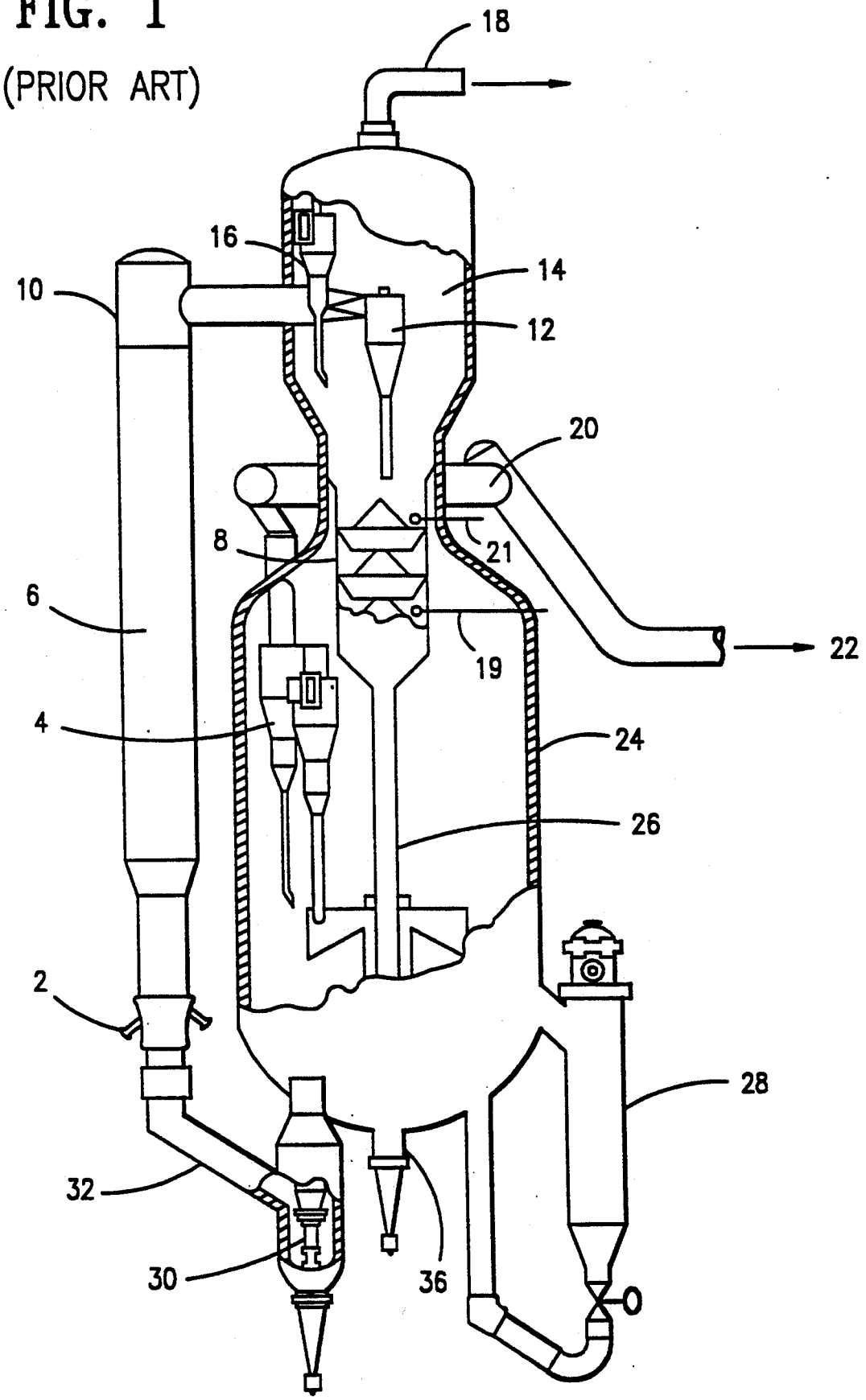
FIG. 1 (PRIOR ART)
FIG. 1 (prior art) is a simplified schematic of an FCC unit of the prior art.

The basics of the FCC process will now be reviewed in conjunction with a review of FIG. 1 (prior art) which is similar to the Kellogg Ultra Orthoflow converter Model F shown as FIG. 17 of Fluid Catalytic Cracking Report, in the Jan. 8, 1990 edition of *Oil & Gas Journal.*

A heavy feed such as a gas oil, or vacuum gas oil is added to riser reactor 6 via feed injection nozzles 2. The cracking reaction is completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14 and eventually is removed via upper cyclones 16 and conduit 18 to the fractionator.

Spent catalyst is discharged down from a dipleg of riser cyclones 12 into catalyst stripper 8 where one, or preferably 2 or more, stages of steam stripping occur, with stripping steam admitted by means not shown in the figure. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled with spent catalyst plug valve 36.

Catalyst is regenerated in regenerator 24 by contact with air, added via air lines and an air grid distributor not shown. A catalyst cooler 28 is provided so heat may be removed from the regenerator, if desired. Regenerated catalyst is withdrawn from the regenerator via regenerated catalyst plug valve assembly 30 and discharged via lateral 32 into the base of the riser reactor 6 to contact and crack fresh feed injected via injectors 2, as previously discussed. Flue gas, and some entrained catalyst, is discharged into a dilute phase region in the upper portion of regenerator 24. Entrained catalyst is separated from flue gas in multiple stages of cyclones 4, and discharged via outlets 8 into plenum 20 for discharge to the flare via line 22.

The process of the present invention can be conducted in such a conventional apparatus, provided the desired residence time in the reactor is achieved by shortening or narrowing the riser, reducing the pressure, increasing the amount of atomization steam and/or increasing throughput.

Usually it will be necessary to add a catalyst cooler, either such as cooler 28 shown, or a separate one operating in the return line from the regenerator to cool the catalyst between the regenerator and the riser reactor.

Having provided an overview of the FCC process, additional details will be provided about catalyst and process conditions.

CRACKING CATALYST

It is essential to use a highly active cracking catalyst. The catalyst zeolite content, as measured by the large pore or Y zeolite content of the makeup catalyst, should be at least 25 wt %, more preferably at least 30 wt %, and most preferably at least 40 wt %. While such catalysts are not per se novel, they are very important to achieving the desired results.

The process also works well with additives, such as those designed to adsorb SOx, to increase octane and olefin yields (ZSM-5), or to promote CO combustion. These are all conventional.

CRACKING REACTOR

A conventional riser cracking reactor can be used, provided it can operate with a catalyst residence time of about 0.25 to 1.5 seconds, and preferably with ½ to 1.0 seconds. Commercial riser reactors operate with 1.5 to 5.0 seconds of vapor residence time, with catalyst residence times being 2 to 3 times higher because of catalyst slip in the riser. Use of increased atomization steam, reduced reactor pressure, a reduced riser diameter, or feed addition higher up in the riser reactor are some ways to reduce catalyst and reactant residence time.

FEED MIXING NOZZLES

Efficient contacting of feed with catalyst is very important in the process of the present invention. While the patent and technical literature mentions the importance of effective feed nozzles, most commercial units have nozzles of rather low efficiency due to the conviction that simplicity of design is paramount.

Good nozzles are available from the M. W. Kellogg Co. and other vendors. Conventional nozzles involving high pressure drops or large amounts of atomizing steam can also be used.

An effective feed nozzle should produce droplets of a sufficiently small size that at riser conditions the feed is over 90% vaporized in less than 0.1 second, and preferably in less than 0.05 second from the time of injection.

REACTOR CONDITIONS

Figure 2:
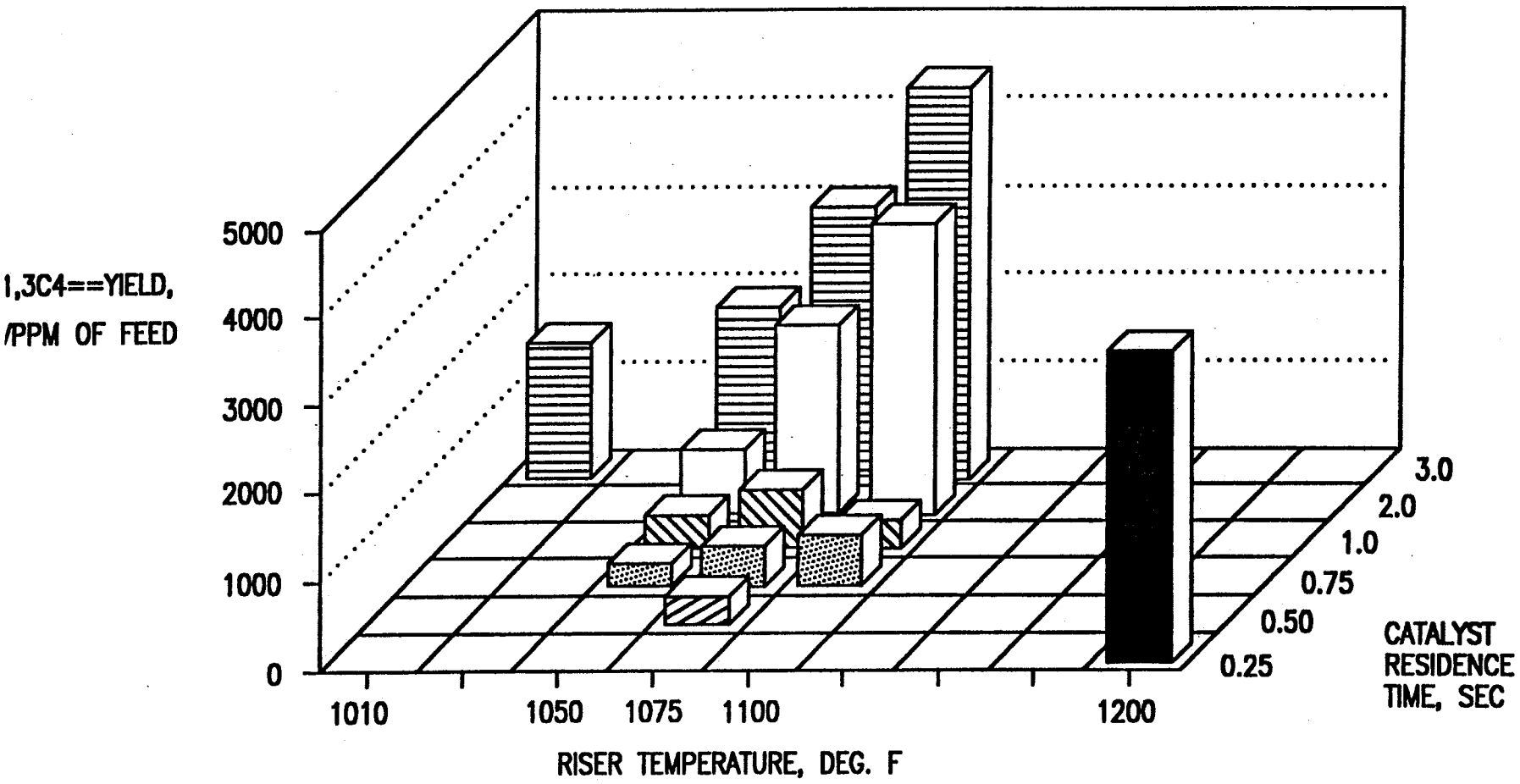
FIG. 2 is a bar chart showing butadiene yields at varying FCC reactor times and temperatures.

The attached FIG. 2 shows preferred operating ranges for the process of the present invention. Preferred temperatures range from 1050° to 1100° F. Preferred catalyst contact times range from 0.25 to 1.5 seconds. However, the preferred contact time and temperature are always coupled.

The process requires operating the cracking reactor so that the catalyst residence time is less than 1.5 seconds, while the cracking reactor temperature is above 1050° F.

As seen from FIG. 2, operation with greater than 1150° F. reactor temperature and a catalyst residence time of less than 0.25 seconds is far from the preferred region. However, this is the region where most prior art work on short contact time cracking took place, and explains why the results were not very promising.

Figure 3:
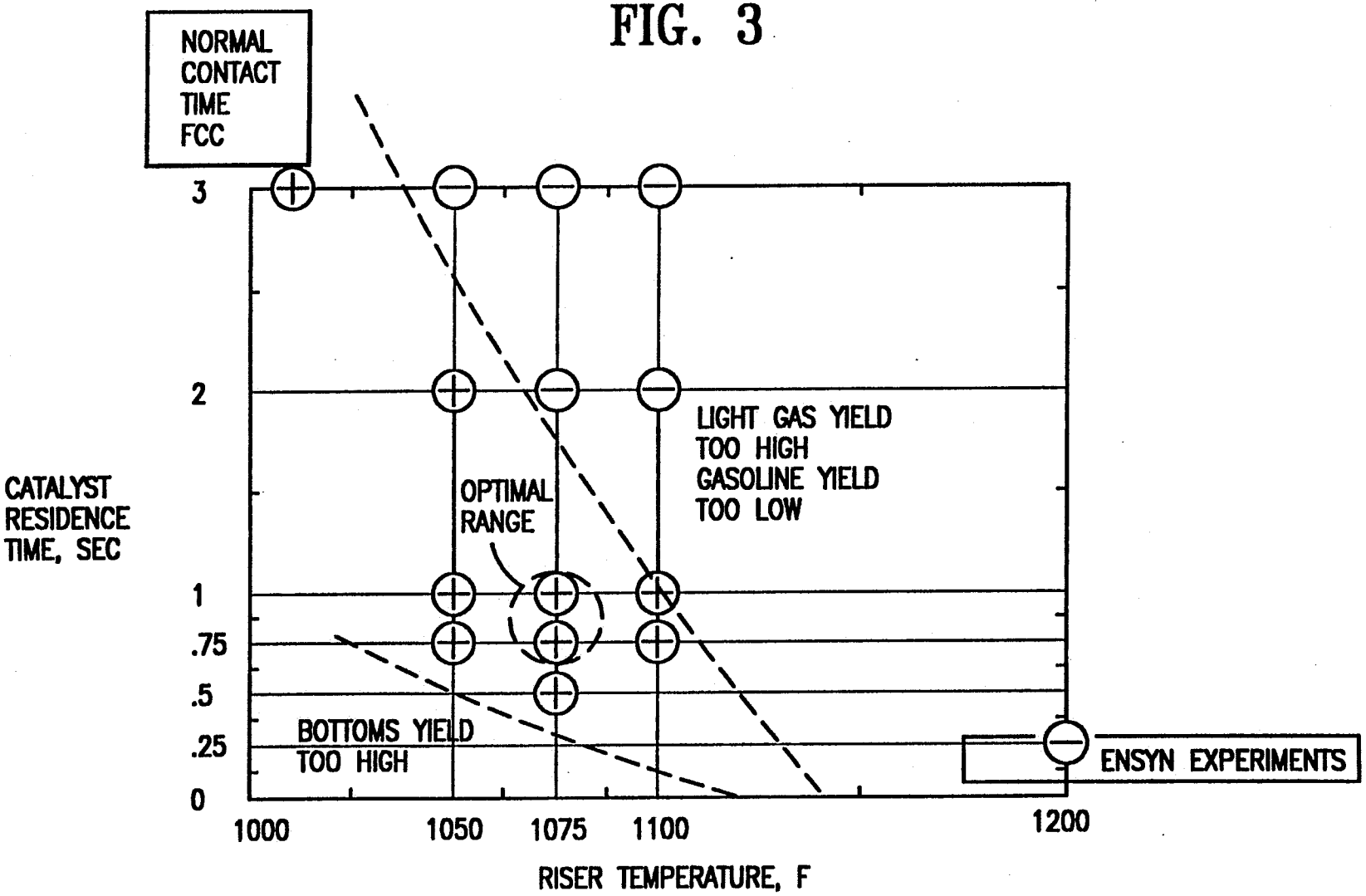
FIG. 3 is a map showing operating regimes and constraints.

For a given riser temperature there is a maximum feasible contact time beyond which catalytic activity is exhausted and thermal cracking controls product selectivity. In addition there is a lower limit to the practical reaction time range, below which conversion cannot be maintained even at increased temperature and bottoms yields are unacceptably high. These constraints together define the feasible operating window for short contact time high temperature cracking. Combinations of catalyst residence time and riser temperature which fall between the thermal cracking limit and the reduced conversion limit are shown in FIG. 3. Those regimes which are suitable are marked with a plus sign while others are given a minus sign. Two points are noteworthy. First, the feasible bracket of contact time narrows as riser temperature is raised and has essentially vanished by 1125° F. This clarifies why no attractive product slate was ever achieved in any internal work or in any published report, with a reactor temperature of 1200° F. or above. Second, maximum swell and maximum product value are achieved at 1075° F. and 0.75 seconds of catalyst residence time because these conditions are roughly equidistant, in a kinetic sense, from the conversion loss of very short times and the thermal $C_3+$ loss at long times.

For maximum swell, and usually for maximum profits, the reactor operates at a temperature of 1075° F., plus or minus 10° F., with a catalyst residence time of 0.8 seconds, plus or minus 0.2 seconds. The optimum temperature is 1075° F., with a catalyst residence time of 0.75. With higher catalyst activity, or fresher catalyst, it is possible to go to somewhat lower temperatures, and shorter contact times within these preferred ranges.

As used above, the term reactor temperature refers to the average reactor temperature, as measured from a point downstream of where catalyst and feed become well mixed to just upstream of the reactor outlet or the reactant/catalyst separation means.

CAT:OIL RATIOS

The process of the invention requires that the reactor operate with fairly high catalyst to oil weight ratios, while remaining within the temperature limits described above.

Preferably the unit operates with more than a 7.5:1 cat:oil weight ratio, more preferably with more than 10:1 and most preferably with more than a 15:1 cat:oil ratio in the reactor.

For many purposes, operation with a 20:1 ratio will be optimal, especially when maximum yield of light olefins, or "swell" of reactor products is desired. Although some slight additional yield benefit can be obtained with even higher ratios —in the 22:1 to 25:1 range or even higher—in commercial practice the benefits will not be worth the costs associated with increased amounts of catalyst circulation.

FEED PREHEAT

Although the process of the present invention can operate with conventional feeds heated a conventional amount—typically to about 600 to 700° F.—in most instances the process will work better when feed is preheated above 700° F., preferably above 725° F., and most preferably above 800° F. This is in contrast to conventional FCC feed preheaters, which usually do not go above 700° F.

The residence time in the reactor is so short that a significant fraction of the total time in the reactor can be wasted or poorly used in simply vaporizing the feed. Great care should be taken to heat and vaporize feeds using conventional direct contact heat exchange with catalyst in the reactor.

With gas oil feeds, complete vaporization of the feed is readily achievable with conventional feed nozzles. With heavier feeds, the feeds most likely to coke in the preheater, higher preheat temperatures are more important. Feeds containing large amounts of non-distillable materials and/or large amounts of asphaltenes, which readily form coke at high temperature, should be heated the most.

Some form of solvent addition, such as a hydroaromatic, may be advantageous to permit higher feed preheat temperatures without fouling the heater. The preferred feeds for this process are atmospheric resids, which contain within them sufficient vacuum gas oil to act as "cutter stock" so solvent addition will not usually be necessary.

CATALYST REGENERATOR

A conventional catalyst regenerator can be used. It should be noted that within the preferred operating regime (high cat:oil ratio, riser outlet temperature below 1100° F.), it is impossible to operate in conventional heat balanced fashion. Operating in the preferred regime with heat-balanced operation would cause the regenerator temperature to drop below 1150° F., a temperature too low to permit reliable coke combustion. It will thus be necessary to operate the regenerator at a temperature higher than the desired temperature of regenerated catalyst entering the riser, and to reconcile these by adding a catalyst cooler, as discussed below.

CATALYST COOLING

It will usually be necessary to cool the catalyst, as the regenerator temperature in every modern FCC unit is well above the optimum temperature for use in my process. This is primarily because of the unusually high cat:oil ratios used and to a lesser extent the degree of feed preheat.

It is beneficial to use regenerated catalyst with a temperature below 1300° F., preferably below 1250° F., and most preferably below 1200° F. The process works very well when the temperature of catalyst charged to the riser reactor is around 1150° F. plus or minus 25° F. However, at this temperature most FCC regenerators will experience greatly reduced coke burning rates, and would achieve almost no CO combustion unless impractically large amounts of a CO combustion promoter such as Pt were added.

Thus while catalyst stripping and regeneration may be conventional, some sort of catalyst cooling is preferred either in the regenerator or on the regenerated catalyst return line to the reactor.

EXAMPLES

Extensive tests were conducted in an FCC riser pilot plant apparatus cracking a Statfjord atmospheric resid using commercial equilibrium catalyst.

TABLE 1

| Properties of Statfjord Atmospheric Resid | |
|---|---|
| API Gravity | 24.0 |
| CCR, wt % | 2.33 |
| Ni, ppm wt | 1.9 |
| V, ppm wt | 3.1 |
| Na, ppm wt | 12.0 |
| S, ppm wt | 5000 |
| N, ppm wt total | 1400 |
| N, ppm wt basic | 527 |
| Distillation, °F. | |
| IBP | 465 |
| 5% | 583 |
| 10% | 640 |
| 20% | 709 |
| 30% | 761 |
| 40% | 808 |
| 50% | 855 |
| 60% | 907 |
| 70% | 979 |
| 80% | 1000 |

TABLE 2

| Equilibrium Catalyst Properties | |
|---|---|
| Carbon Content (As Received), % | 0.0756 |
| Density | |
| Packed, g/cc | 0.96 |
| Particle, g/cc | 1.385 |
| Real, g/cc | 2.648 |
| Pore Volume, cc/g | 0.34 |
| Surface Area, $m^2/g$ | 124 |
| Unit Cell Lattice Parameter, A | 24.32 |
| Metals Content | |
| Nickel, ppm | 600 |
| Vanadium, ppm | 1000 |
| Magnesium, ppm | 3000 |
| Antimony, ppm | <900 |
| Copper, ppm | 250 |
| Iron, ppm | 7000 |
| Sodium, ppm | 18000 |
| Clean-Burned FAI Results | |
| Conversion, vol % | 66.2 |
| $C_5$+ Gasoline Yield, vol % | 58.2 |
| $C_4$s Yield, vol % | 11.2 |
| Dry Gas Yield, wt % | 4.1 |
| Coke Yield, wt % | 0.96 |
| $C_{letgo}$, wt % | 0.431 |

Example 1 (Prior Art). The pilot unit was operated at conventional conditions, a riser top temperature of 1010° F., a catalyst contact time in the riser of 3.1 seconds, with a cat:oil ratio of 4.5:1 wt:wt. Yields are presented in Table 3.

Example 2 (invention). The pilot unit was operated at conditions which produced the highest total product value, based on prices likely to prevail when a commercial short contact time FCC unit would be built. The test unit was an isothermal pilot plant and operated at a rise temperature of 1076° F., a catalyst contact time of 0.77 seconds in the riser, and a 20.7:1 cat:oil weight ratio. The catalyst was cooled upstream of the riser to 1147° F. Yields are presented in Table 3, along with yields from the same cracking unit, operating at conventional conditions.

TABLE 3

Short Contact Time FCC Experiments (CT-176): Optimal Operating Conditions and Product Yields

| | Optimized* Normal Contact Time FCC | Optimized** Short Contact Time FCC | Shift |
|---|---|---|---|
| Riser Temp, °F. | 1010 | 1076 | |
| Contact Time, sec | 3.1 | 0.77 | |

TABLE 3-continued

Short Contact Time FCC Experiments (CT-176): Optimal Operating Conditions and Product Yields

| | Optimized* Normal Contact Time FCC | Optimized** Short Contact Time FCC | Shift |
|---|---|---|---|
| C/O, wt/wt | 4.5 | 20.7 | |
| Preheat Temp, °F. | 706 | 707 | |
| Cat Inlet Temp, °F. | 1280 | 1147 | |
| Conversion, vol % | 77.9 | 79.5 | 1.6 |
| $C_5$+ Gasoline, vol % | 55.5 | 55.3 | −0.2 |
| LFO, vol % | 18.0 | 16.1 | −1.9 |
| HFO, vol % | 4.1 | 4.4 | 0.3 |
| $C_4$=, vol % | 9.5 | 10.0 | 0.5 |
| $iC_4$, vol % | 5.7 | 8.4 | 2.7 |
| $C_3$=, vol % | 10.4 | 12.5 | 2.1 |
| $C_2$− gas, wt % | 6.4 | 4.4 | −2.0 |
| Coke, wt % | 4.0 | 5.0 | 1.0 |
| G + A, vol % | 88.6 | 92.6 | 4.0 |
| Coke Selectivity ($k_c$) | 0.55 | 0.77 | 0.22 |
| Gas Selectivity ($k_g$) | 0.08 | 0.08 | — |
| R + O | 93.3 | 94.2 | 0.9 |
| M + O | 81.0 | 82.4 | 1.4 |
| (R + M)/2 | 87.1 | 88.3 | 1.2 |

*Highest total product value of conventional FCC experiments.
**Highest total product value of short contact time FCC experiments.

Examples 3–12

Additional tests were conducted in the pilot plant at varying conditions. The purpose of the test was to optimize product swell (total C330 liquid volume) during cracking, which is independent of the price of the various catalytic cracking products.

TABLE 4

Short Contact Time FCC Experiments (CT-176): Optimal Operating Conditions for Product Swell

| Rank | Riser Temp, °F. | Contact Time, sec | C/O Ratio, wt/wt | Total Volume % of $C_3$s/$C_4$s $C_5$+ Gaso/LFO/HFO |
|---|---|---|---|---|
| 1 | 1074 | 0.96 | 12.1 | 118.2 |
| 2 | 1076 | 0.77 | 20.7 | 112.6 |
| 3 | 1076 | 0.40 | 21.2 | 112.3 |
| 4 | 1077 | 1.01 | 29.6 | 111.5 |
| 5 | 1073 | 1.21 | 17.1 | 111.4 |
| 6 | 1098 | 1.04 | 18.8 | 111.3 |
| 7 | 1076 | 1.05 | 23.0 | 111.0 |
| 8 | 1049 | 0.74 | 12.5 | 110.8 |
| 9 | 1075 | 0.61 | 20.5 | 110.7 |
| 10 | 1097 | 0.99 | 15.7 | 110.3 |

FIG. 2 is a bar chart showing butadiene yields at varying FCC catalyst residence times and reaction temperatures.

DISCUSSION

Considerably oversimplifying several years of work, I have the following observations as to why the invention works, and the best way to use it in new and existing FCC units.

I realized the trend to short contact time and high temperature, with downflow operation, was going in the wrong direction. While hot regenerated catalyst permitted short contact time cracking, it also created conditions which lead to excessive thermal cracking, and used a process flow (downflow) which led to inefficient use of cracking catalyst.

Both upflow and downflow reactors in commercial use demonstrate pulsing. This is similar to alternating regions of greater and lesser catalyst density in a vertical direction. Pulsing occurs independent of the tendency of FCC catalyst to accumulate in an annular layer on the walls of riser reactors. If a droplet of heavy feed enters a downflow reactor and has the misfortune to end up n a catalyst lean pulse, it will have much less contact with catalyst than a similar droplet ending up in a catalyst rich pulse. Moreover, most downflow reactor designs do not allow maximum use of the catalyst: gravity pulls the catalyst particles ahead of the vapor and they exit the riser before the vapors with which they entered. The zeolite cracking catalysts used today, especially those with 25–40% zeolite, still retain substantial cracking activity despite a large amount of coke, and this activity is not effectively used in a downflow reactor.

In a riser reactor, catalyst slip mitigates the negative effect of pulsing. Vapors flow faster than catalyst up the riser, and thereby pass through various catalyst pulses, experiencing the intended average cat:oil ratio. Because of this, catalyst stays in the reactor longer than the vapors, usually by a factor of 2 to 3 and does additional cracking. A 20:1 cat:oil ratio in an upflow riser reactor can, because of slip, achieve a conversion equal to 22:1 to 30:1 cat:oil ratio in a downflow reactor. Thus the riser's foibles are ameliorated by forcing vapors to pass through thick and thin regions of catalyst and made to do useful work. This aspect of gas-solids flow has never been used effectively before in short contact time cracking. With a well preheated feed and large amounts of cooled catalyst, the benefits of upflow are further enhanced.

I claim:

1. A process for the fluidized catalytic cracking of a feed containing hydrocarbons boiling above 650° F. comprising:

a) preheating said feed to a temperature above 650° F. and sufficient to vaporize at least 50 wt % of said feed and produce a preheated feed;

b) charging to a base portion of a riser reactor said preheated feed and a stream of cooled, regenerated fluidized catalytic cracking catalyst containing at least 25 wt % large pore zeolite, based on the zeolite content of makeup catalyst to said cracking unit, and wherein the weight ratio of cooled, regenerated catalyst to preheated feed is at least 7.5:1 and produces a catalyst and feed mixture having a mix temperature of at least 1050° F. but below 1200° F.;

c) riser cracking said mixture in said riser reactor for a catalyst residence time of less than 1.5 seconds to produce a mixture of cracked products and spent catalyst which are discharged from an upper portion of said riser reactor at a riser top temperature between 1025° and 1125° F.;

d) separating said discharged mixture to produce a stream of catalytically cracked products which are removed as a product and a stream of spent catalyst containing entrained and absorbed catalytically cracked products and coke;

e) stripping said spent catalyst in a stripping means by contact with a stripping gas at stripping conditions to produce stripped catalyst;

f) regenerating said stripped catalyst in a catalyst regeneration means at catalyst regeneration conditions including a temperature above 1150° F. and contact with an oxygen containing gas to burn coke from spent catalyst, and produce regenerated catalyst having a temperature above 1150° F.; and g) cooling said regenerated catalyst in a catalyst cooling means to produce cooled regenerated catalyst;

h) recycling said cooled regenerated catalyst to said cracking reactor to contact said feed.

2. The process of claim 1 wherein the mix temperature of catalyst and feed is at least 1075° F., and the catalyst has an average temperature in the reactor within the range of 1050° to 1100° F., and the catalyst has a residence time in the reactor of 0.5 to 1.0 seconds.

3. The process of claim 2 wherein the average catalyst temperature is 1065° to 1085° F. and the catalyst residence time is 0.65 to 0.85 seconds.

4. The process of claim 1 wherein the hydrocarbon feed is atomized into droplets below 500 microns when injected into said riser reactor.

5. The process of claim 1 wherein the hydrocarbon feed is atomized into droplets below 200 microns when injected into said riser reactor.

6. The process of claim 1 wherein the hydrocarbon feed is atomize into droplets below 100 microns when injected into said riser reactor.

7. The process of claim 1 wherein the feed is preheated to at least 750° F.

8. The process of claim 1 wherein the feed is preheated to at least 800° F.

9. The process of claim 1 wherein the catalytic cracking conditions include a catalyst to oil weight ratio of from 10:1 to 21:1.

10. The process of claim 1 wherein the catalytic cracking conditions include a catalyst to oil weight ratio of from 16:1 to 21:1.

11. The process of claim 1 wherein the feed is an atmospheric resid and contains at least 1.0 wt % Conradson Carbon Residue which readily forms coke at a temperature above 800° F., and said feed is preheated to a temperature of at least 800° F., and said catalyst regeneration conditions produce a regenerated catalyst having a temperature above 1300° F. which is cooled in a catalyst cooling means to a temperature of about 1075°–1150° F., and wherein the catalyst to oil weight ratio in said riser is at least 10:1, and the riser top temperature is about 1050°–1100° F.

12. The process of claim 1 wherein the butadiene content of the cracked product is at least periodically measured and at least one of the cracking reactor catalyst residence time and average reactor temperature are changed in response to said butadiene content.

13. A method of cracking a heavy feed comprising at least 10 wt % hydrocarbons not recoverable by distillation at atmospheric pressure to catalytically cracked products including at least 50 LV % gasoline and less than 0.15 wt % butadiene based on weight of fresh feed to said cracking reactor, comprising:

a) preheating said feed to a temperature above 700° F.;

b) contacting in the base of a riser reactor said preheated feed with a stream of cooled fluidized catalytic cracking catalyst containing at least 30 wt % Y zeolite, based on the Y zeolite content of makeup catalyst to said cracking unit, to produce a catalyst and feed mixture having a temperature of 1050° F. to 1150° F.;

c) riser cracking said mixture for a catalyst residence time of 0.5 to 1.0 seconds to produce a mixture of cracked products and spent catalyst which are discharged at a reactor outlet temperature, and wherein the reaction conditions include a cat:oil weight ratio above 10:1 and a riser reactor outlet temperature of 1050° to 1100° F.;

d) separating said mixture to produce a stream of catalytically cracked products which are removed as a product and a stream of spent catalyst containing entrained and absorbed catalytically cracked products and coke;

e) analyzing at least the C4+portion of said cracked products to determine the gasoline yield and the butadiene content thereof and reducing reaction severity by adjusting at least one of the catalyst residence time and riser outlet temperature in response to said butadiene when butadiene content increases above a predetermined level below 1500 wt ppm of feed, and increasing reaction severity when gasoline yield decreases below a predetermined level equal to at least 50 LV % of fresh feed;

f) stripping said spent catalyst in a stripping means by contact with a stripping gas at stripping conditions to produce stripped catalyst;

g) regenerating said stripped catalyst in a catalyst regeneration means at catalyst regeneration conditions including contact with an oxygen containing gas to produce regenerated catalyst having a temperature above 1300° F.;

h) cooling, in a catalyst cooling means, said regenerated catalyst, to produce cooled regenerated catalyst having a temperature below 1200° F.; and h) recycling said cooled regenerated catalyst to said cracking reactor to contact said feed.

14. The process of claim 13 wherein the reaction severity is reduced when butadiene content increases above 1000 wt ppm.

15. The process of claim 13 wherein the gasoline is the C5–12 portion of the catalytically cracked products.

16. The process of claim 13 wherein the mix temperature of catalyst and feed in the riser is 1065° to 1085° F. and the catalyst residence time is 0.65 to 0.85 seconds and the catalyst has a zeolite Y content of at least 40 wt %, based on the Y zeolite content of makeup catalyst.

17. The process of claim 13 wherein the hydrocarbon feed is atomized into droplets below 200 microns when injected into said riser reactor.

18. The process of claim 13 wherein the feed is preheated to at least 750° F.

19. The process of claim 13 wherein the feed contains more than 2.0 wt % CCR, and the catalytic cracking conditions include a catalyst to oil weight ratio of from 10:1 to 21:1.

20. The process of claim 13 wherein the catalytic cracking conditions include a catalyst to oil weight ratio of from 16:1 to 21:1.

* * * * *